US008836600B2

(12) United States Patent
Lafleur

(10) Patent No.: US 8,836,600 B2
(45) Date of Patent: Sep. 16, 2014

(54) QUADRIFILAR HELIX ANTENNA SYSTEM WITH GROUND PLANE

(75) Inventor: Phil Lafleur, Gloucester (CA)

(73) Assignee: Skywave Mobile Communications Inc., Ottawa, ON (CA)

( * ) Notice: Subject to any disclaimer, the term of this patent is extended or adjusted under 35 U.S.C. 154(b) by 363 days.

(21) Appl. No.: 12/955,081

(22) Filed: Nov. 29, 2010

(65) Prior Publication Data

US 2012/0133568 A1 May 31, 2012

(51) Int. Cl.
*H01Q 19/00* (2006.01)

(52) U.S. Cl.
USPC ..... 343/833

(58) Field of Classification Search
USPC ..... 343/833, 895, 725
See application file for complete search history.

(56) References Cited

U.S. PATENT DOCUMENTS

| | | | | |
|---|---|---|---|---|
| 6,476,773 | B2 * | 11/2002 | Palmer et al. | 343/795 |
| 6,483,471 | B1 * | 11/2002 | Petros | 343/725 |
| 6,538,611 | B2 * | 3/2003 | Noro | 343/725 |
| 7,091,917 | B2 * | 8/2006 | Jan et al. | 343/725 |
| 7,133,810 | B2 | 11/2006 | Butler et al. | |
| 8,508,426 | B2 * | 8/2013 | Honda et al. | 343/834 |
| 2002/0105471 | A1 | 8/2002 | Kojima et al. | |
| 2003/0210193 | A1 * | 11/2003 | Rossman et al. | 343/725 |
| 2004/0017327 | A1 | 1/2004 | Petropoulos | |

FOREIGN PATENT DOCUMENTS

EP 1355377 A2 10/2003

OTHER PUBLICATIONS

"The Sleeve-Cage Monopole and Sleeve Helix for Wideband Operation", Shawn D. Rogers et al., IEEE Antenas and Propagation Society International Symposium, vol. 2, 1999 XP-002671978, Piscataway, NJ, USA, pp. 1308-1311.

Method for Broadening the Beamwidths ofCrossed Dipoles for Wideband Marine GPS Applications, Y.-F. Wei et al. Progress in Electromagnetics Research Letters, vol. 12, 31-40, 2009.

Meander Line Technique for Size Reduction of Quadrifilar Helix Antenna, Daniel Chew et al, IEEE Antennas and Wireless Propagation Letters, vol. 1, 2002.

* cited by examiner

*Primary Examiner* — Huedung Mancuso
(74) *Attorney, Agent, or Firm* — Marks & Clerk; Richard J. Mitchell

(57) ABSTRACT

A quadrifilar helix antenna system with a finite ground plane has a pair of bifilar helical elements extending upwardly from the finite ground plane. A symmetrical array of monopole elements surrounds the lower portion of the pair of bifilar helical elements in the near field so as to load the lower portion and thereby raise the phase center of the antenna to improve the circularly polarized far-field radiation at low elevation angles.

20 Claims, 7 Drawing Sheets

Cross section of Ez

Cross section of Ex

Cross section of Ex

Cross section of Ez

Cross section of Ez

Cross section of Ex

Cross section of Ex

35mm monopoles

10mm Collar (similar to no collar)

40mm Collar

QUADRIFILAR HELIX ANTENNA SYSTEM WITH GROUND PLANE

FIELD OF THE INVENTION

This invention relates to the field of antenna systems, and in particular to a quadrifilar helix antenna system mounted on a finite ground plane.

BACKGROUND OF THE INVENTION

In applications such as mobile/remote asset monitoring/tracking using GPS or like global positioning systems, it is desirable that the antenna be as omnidirectional as possible, providing sufficient gain for reliable system operation down to very low elevation angles. For marine applications in particular, operation down to negative elevation angles is desirable to account for operation in northern latitudes in high seas.

Furthermore, most satellite communication systems see substantially improved capacity/efficiency and reliability when the amplitude spread between inbound, also known as uplink or return, link signals is reduced. CDMA systems can detect more simultaneous carriers. TDMA systems can more reliably detect collisions. FDMA systems can avoid inter-channel interference.

While a number of factors contribute to amplitude spread, such as multipath and satellite beam contours variation, a substantial portion of amplitude spread is related to mobile terminal antenna gain variation over azimuth and elevation angle. Elevation angle variation is typically larger than azimuth variation. Therefore, it is desirable for the radiation pattern to be as uniform as possible over solid angle of interest.

Antenna structures typically used for these applications include crossed dipole and Quadrifilar helix antennas. Both of these structures are circularly polarized antennas, which is a requirement for mobile satellite communications. The degree of circular polarization is defined in terms of the axial ratio, which is the ratio of orthogonal components of the electric field. For a fully circularly polarized antenna, which is desirable in a GPS application, both components are of equal magnitude, and the axial ratio is therefore unity.

The difficulty with these structures is that they require significant height to achieve the low elevation angle performance required by some systems. For example, a quadrifilar helix antenna mounted on a 20 cm ground plane requires a 10 cm height helix achieve −2 dBic at 5 degrees elevation angle. Variation between boresight and 5 degree elevation angle is 5 dB.

While a quadrifilar helix antenna is symmetrical and does not require a ground plane, in practice a ground plane is present because of the need to provide electronic circuitry in the same housing as the antenna. The printed circuit board mounting the electronic circuitry provides the ground plane. While cost effective, this level of integration due to the presence of a ground plane is a limiting factor in performance.

The ground plane inhibits operation at low elevation angles because it blocks/interferes with the radiation from the antenna. The radiation pattern at low elevation angles is of interest because if, for example, the antenna is mounted on a ship, the ship will roll from side to side, and the ground plane can tilt several degrees. In order to pick up a satellite close to the horizon, the antenna needs to be able to respond to signals at angles below the ground plane. Moreover, it is important to maintain an axial ratio as close to unity as possible in order to maintain circular polarization.

In the paper entitled "Method for Broadening the Beamwidth of Crossed Dipoles for GPS Applications", Wei et al. Progress in Electromagnetics Research Letter, Vol. 12, 31-40, the authors propose the use of parasitic strips around the crossed dipole antenna for the purposes of broadening the beam. While the beam is broadened at some frequencies, this proposal does reduce the required height to achieve a given level of performance. The antenna disclosed is 8 cm tall and exhibits approximately 8 dB of variation between boresight and 5 degree elevation angle. This is substantially worse than the 5 dB of the quadrifilar antenna referred to above.

A number of factors contribute to the relatively poor performance of this configuration. Firstly, the crossed-dipole configuration itself is quite directive which implies that a lot of improvement is required by the monopoles to achieve the desired level of performance. Secondly, because of the height of the crossed dipole relative to parasitic strips, the amount of radiation that they can influence is limited. If one tried to lower the cross-dipole antenna in order to promote coupling to the parasitic strips, this would lead to reduced low elevation performance due to ground plane interference/blockage. Moreover, the amount by which the height can be lowered is limited due to the requirement that the dipole extend nominally $\lambda/4$ above the ground plane.

SUMMARY OF THE INVENTION

Embodiments of the present invention substantially reduce the height requirement to achieve a predefined level of low elevation angle performance despite the presence of a ground plane.

According to the present invention there is provided a quadrifilar helix antenna system with a finite ground plane, comprising a pair of bifilar helical elements on a core extending upwardly from the finite ground plane; and a symmetrical array of monopole elements surrounding the lower portion of the pair of bifilar helical elements in the near field so as to load the lower portion and thereby raise the phase center of the antenna to improve the circularly polarized far-field radiation at low elevation angles.

Embodiments of the invention are based on the surprising discovery that parasitic monopoles placed around the antenna improve the low elevation angle performance of the antenna while maintaining an acceptable axial ratio. It would be expected that the monopole elements would favor vertical polarization, but despite this the inventor has found that he can maintain a good axial ratio at low elevation angles with the parasitic monopoles. The inventor believes this to be due to the fact that while the loading moves the phase center up, radiation remains circularly polarized because it is the QFHA antenna that is the primary radiator, not the monopoles.

Separate monopole elements can be placed around the antenna on the ground plane in the near field, or alternatively they can be in the form of a continuous collar extending around the antenna. The collar is really the limiting case of a closely packed array of monopoles.

Embodiments of the invention allow for significant reduction in height while maintaining good low elevation angle performance and minimizing radiation pattern variation between boresight and the 5-degree elevation angle.

Embodiments of the present invention achieve this result by combining an inherently low-directivity quadrifilar helix antenna structure that naturally radiates more energy at low elevation angles and symmetrically placed parasitically coupled monopole antennas with a beam-broadening effect and wherein the height of the helix is related to the length of the parasitic monopoles to promote tighter/optimal parasitic coupling.

Despite the linear far-field characteristics of parasitic monopole elements, good axial ratio performance is maintained down to low elevation angles. This is due to its effect on both horizontal and vertical field components in the near field. The primary effect of the monopoles is to push up the phase center, thereby reducing the effect of the ground plane.

Further refinements can be made to reduce azimuth ripple by increasing the number of parasitic monopoles to eight or more. Further reductions in height can be made by using dielectric loading and/or meandering techniques, and further improvements in low elevation angle gain can by obtained by using a larger quadrifilar helix. The performance would be better than the performance of the taller helix alone. A meandering technique is disclosed in "Meander Line Technique for Size Reduction of Quadrifilar Helix Antenna", Daniel K. C. Chew et al., IEEE Antennas and Wireless Propagation Letters, Vol. 1, 2002, the contents of which are herein incorporated by reference.

Incorporation of these refinements requires further optimization to optimize parasitic coupling for low elevation angle performance.

According to another aspect of the invention there is provided a method of improving the performance of a quadrifilar helix antenna system with a finite ground plane at low elevation angles, comprising surrounding a lower portion of a pair of bifilar helical elements forming part of the antenna system with a symmetrical array of monopole elements in the near field; and using the symmetrical array of monopole elements to load the lower portion and thereby raise the phase center of the antenna.

BRIEF DESCRIPTION OF THE DRAWINGS

The invention will now be described in more detail, by way of example only, with reference to the accompanying drawings, in which.

DETAILED DESCRIPTION OF EMBODIMENTS OF THE INVENTION

Figure 1:
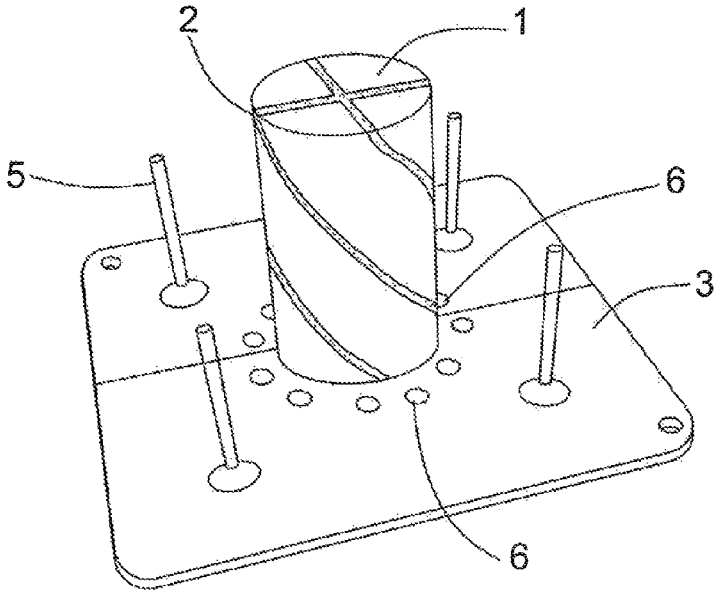
FIG. 1 is an illustration of a quadrifilar helix antenna system with ground plane and parasitic monopoles.

The antenna system shown in FIG. 1 comprises a cylindrical dielectric core 1 with a pair of conductive bifilar helical elements 2 mounted on a copper ground plane 3 and shorted at the top of the antenna. The system illustrated is for demonstration purposes. In reality, the ground plane 2 is likely to be printed circuit board containing all the electronics associated with the antenna, and which is mounted in the same housing (not shown).

Four vertical monopoles 5, in the form of upstanding copper rods are electrically mounted on the ground plane as illustrated in FIG. 1. The monopoles 5, which are arranged in the near field, are located at the corners of a square, symmetrically disposed about the antenna. The monopoles 5 are positioned in this embodiment such that the diagonals of the square bisect the angle between the termination points 6 of the bifilar elements on the ground plane, although good performance can still be achieved with other orientations of the bifilar elements.

In this example, the height and position of the monopoles 5 are such that the phase centers for different field components of the radiation are lined up, which is required for good axial ratio performance. The height of the monopoles is also selected such that it improves low elevation angle coverage without negatively affecting pattern symmetry.

In this embodiment, the core 1 is 5.8 cms tall and the parasitic monopoles are 3.5 cms tall. The monopoles therefore are about 0.6 the height of the core 1.

It is possible to increase the number of monopoles, or alternatively employ a continuous collar extending around the dielectric core 1.

The size of the ground plane depends on the requirements of the circuitry. However, if the ground plane is too large no amount of height will allow good performance to be achieved at negative or near-zero elevation angle. Ideally the ground plane size should be less than a wavelength across (~19 cm in the L band). The wavelength used throughout of course refers to the designed operational wavelength of the antenna.

The positioning of the monopoles needs to be carefully determined. If the monopoles are too close, they distort the current distribution on the quadrifilar helical antenna (QFHA), if they are too far away, they fail to load the QFHA enough to raise the phase center. The sweet or optimum spot lands somewhere between ⅙th of a wavelength and ⅒th of a wavelength (currently 2.5 cm).

The monopoles should be kept electrically short, i.e. less than ¼ of a wavelength to avoid them acting as true parasitic re-radiators, which might degrade axial ratio. Currently the monopoles are 35 mm tall which is under ⅕th of a wavelength.

Figure 2:
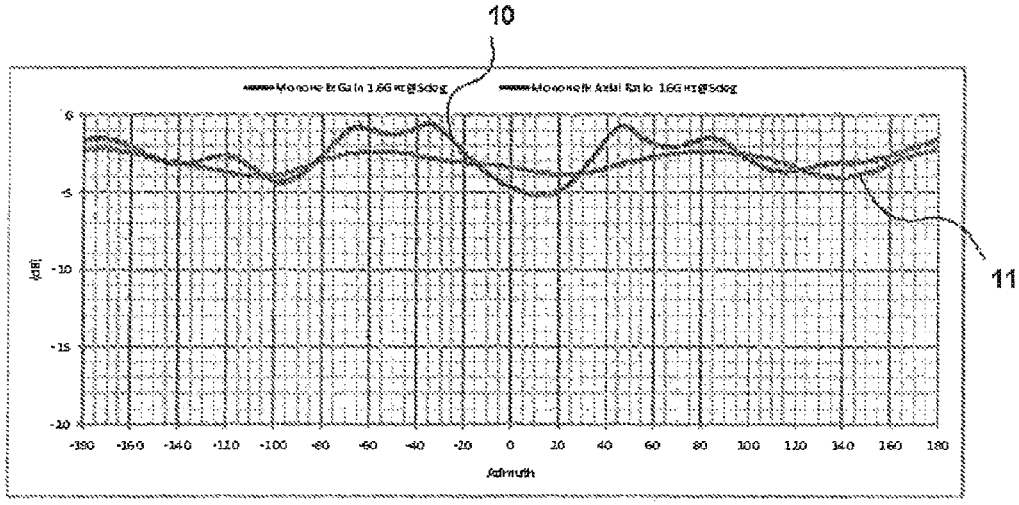
FIG. 2 is a graph of the radiation pattern for an antenna system in accordance with an embodiment of the invention over azimuth at 5 degrees elevation.

FIG. 2 shows the azimuthal performance characteristics at 5 degrees elevation. The line 10 shows the axial ratio at 1.6 GHz and the line 11 shows the helix gain. What is most notable is that the axial ratio remains high over the whole azimuth range.

Figure 3:
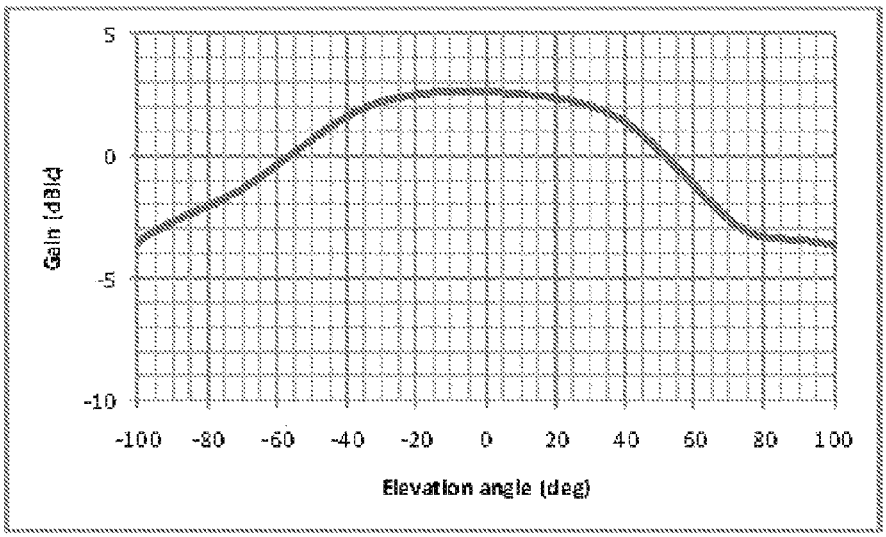
FIG. 3 is a graph of the radiation pattern for the antenna system over elevation

FIG. 3 shows the radiation pattern by elevation. These graphs show excellent low elevation angle performance despite the smaller size of the antenna compared to a conventional quadrifilar helix antenna and reduced variation between boresight and low elevation angles.

In order to try to explain the observed phenomena experiments were carried out on a quadrifilar helix antenna with and without the monopoles and also in the presence of a collar.

Figure 4A:
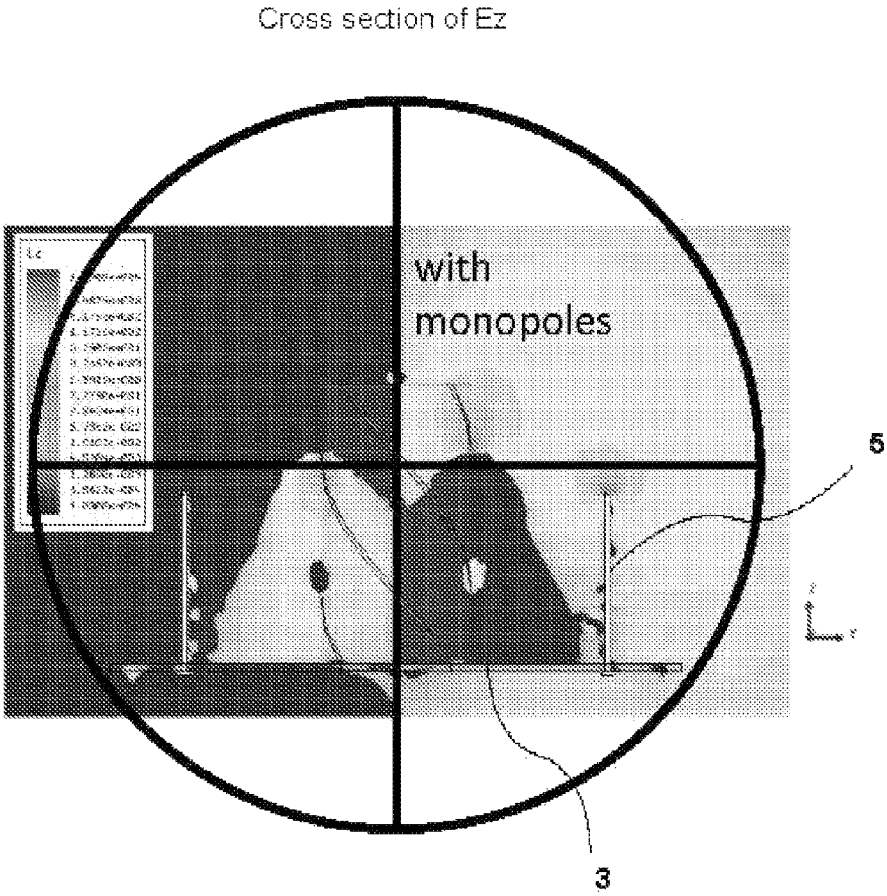
FIGS. 4*a* and 4*b* are cross sections through the Ez electric field component with and without monopoles.
Figure 4B:
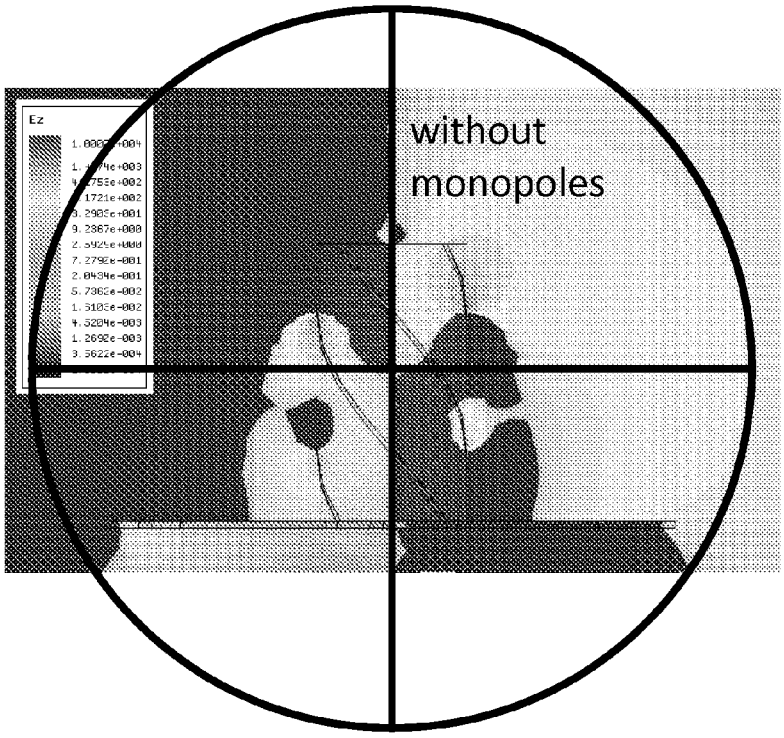

FIG. 4*a* is a cross section of the z component of the electric field with monopoles. Compared to the situation shown in FIG. 4*b* in the absence of monopoles, the phase center is pushed up relative to the ground plane. This reduces the impact of the ground plane at low elevation angles. It is like making the antenna taller without changing its physical dimensions.

Figure 5A:
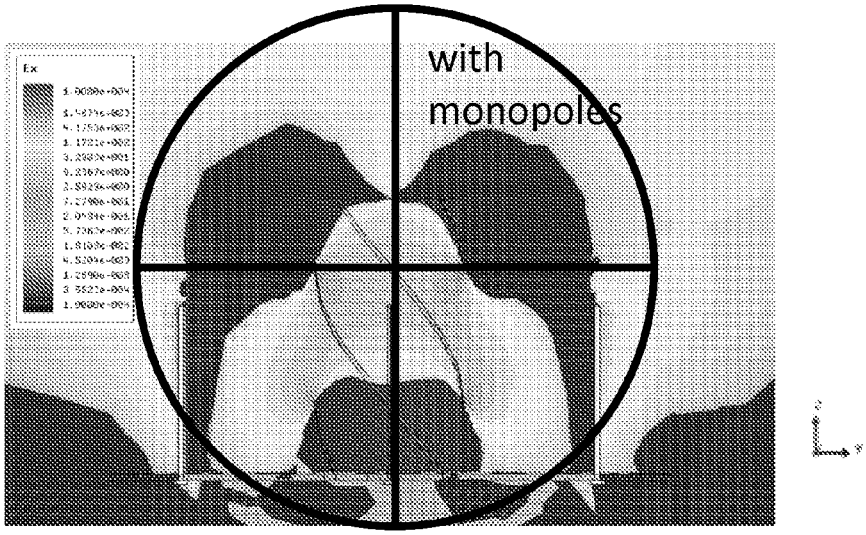
FIGS. 5*a* and 5*b* are cross sections through the Ex electric field component with and without monopoles.
Figure 5B:
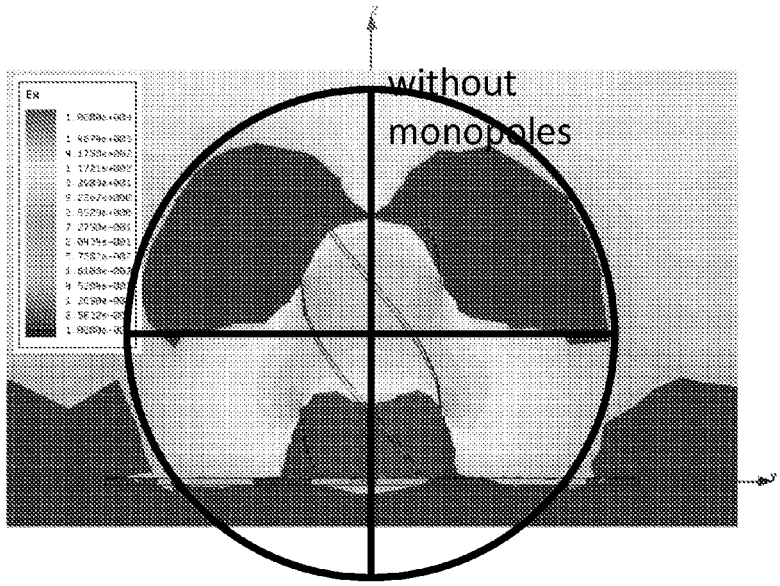

FIGS. 5*a* and 5*b* are similar diagrams for the x component of the electric field. These diagrams shown that the radiation bends around the Ex cavity created by the monopoles, but is not actually blocked. They also show the phase center pushed up relative to the ground plane, which as noted reduces the impact of the ground plane on low elevation angles.

Figure 6A:
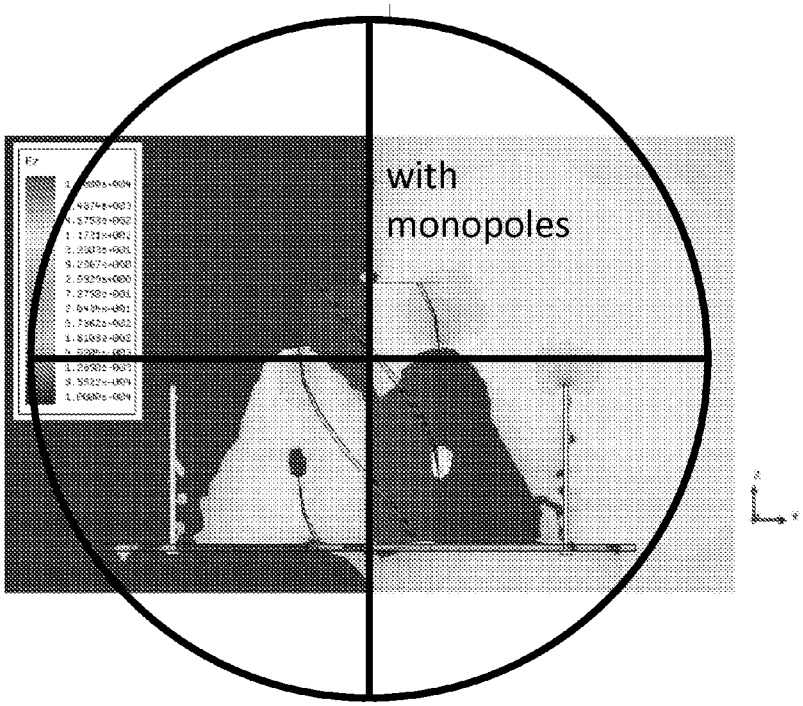
FIGS. 6*a* and 6*b* are cross sections through the Ez electric field component with and without collars.
Figure 6B:
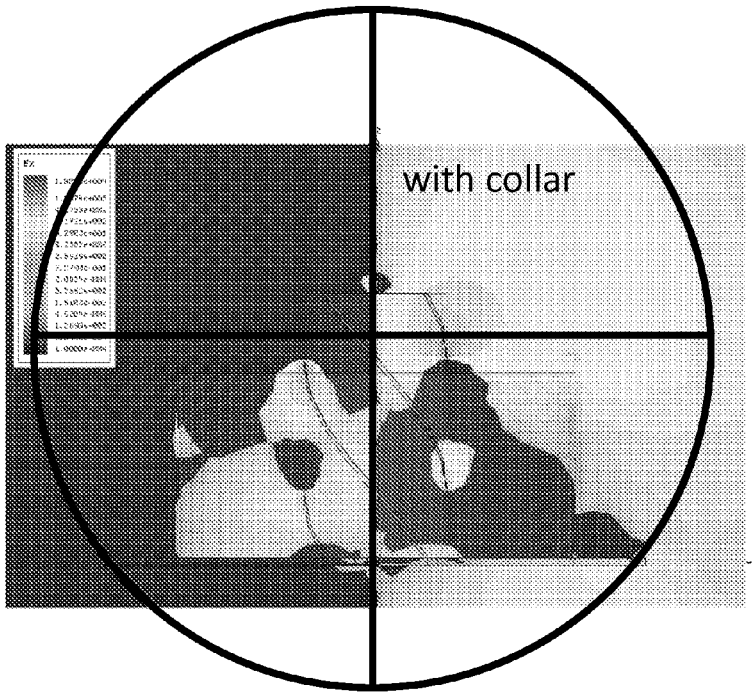

FIGS. 6*a* and 6*b* show similar diagrams wherein a metal collar is used instead of the monopoles. FIG. 6*b* shows more shift than the case with the monopoles (FIG. 6*a*). Also, the phase center is different for the Ex and Ez components (compare with FIGS. 7*a* and 7*b*). FIG. 7*b* with the collar shows less shift than the case with the monopoles shown FIG. 7*a*. However, it is important to note that the effect is observed when the collar is used. The collar has a similar loading effect, but not a monopole-like parasitic effect, which confirms that it is the loading that matters, not the fact that the monopoles are acting as a parasitic radiator.

Figure 7A:
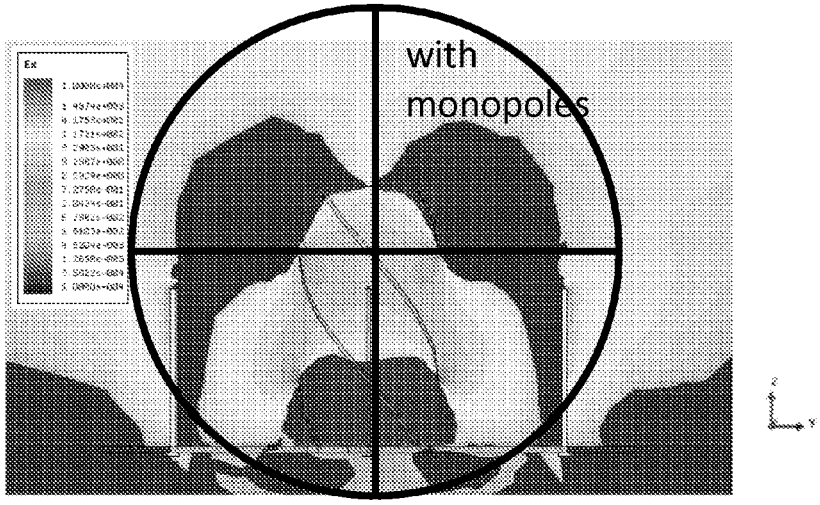
FIGS. 7*a* and 7*b* are cross sections through the Ex electric field component with and without collars.
Figure 7B:
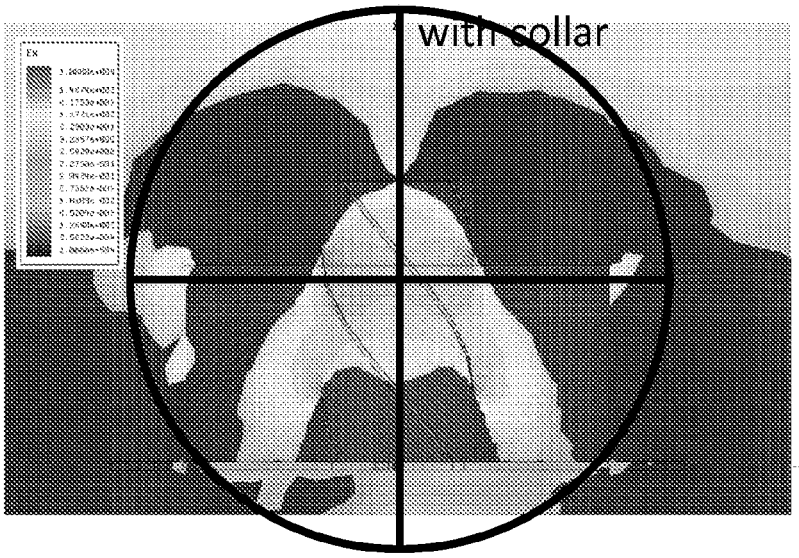

The Ez diagrams shown in FIGS. 7*a* and 7*b* show slightly degraded pattern symmetry in that the phase centers do not exactly line up, which is believed to be due to heavy loading from the collar affecting the current distribution on the helix.

Figure 8A:
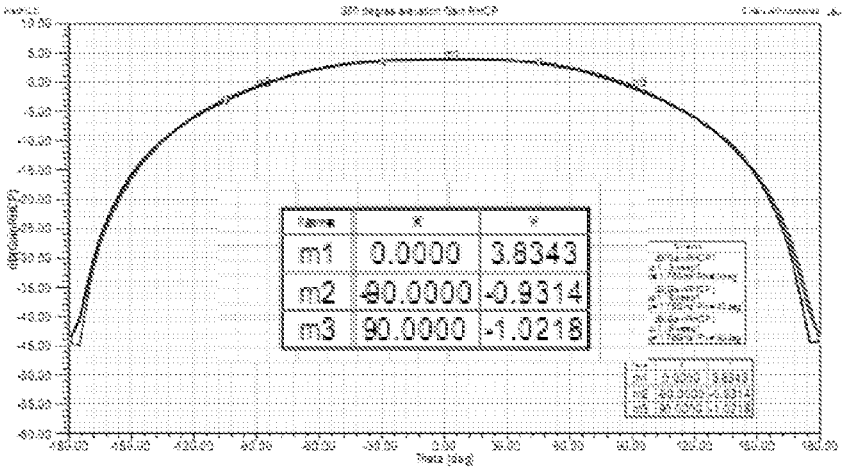
FIGS. 8*a* to 8*c* are diagrams showing the radiation patterns of antennas with monopoles and collars.
Figure 8B:
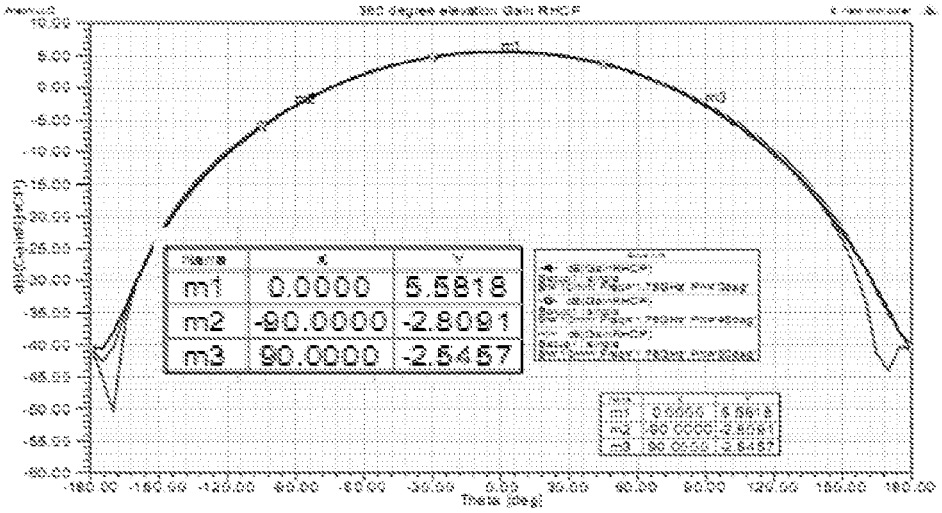
Figure 8C:
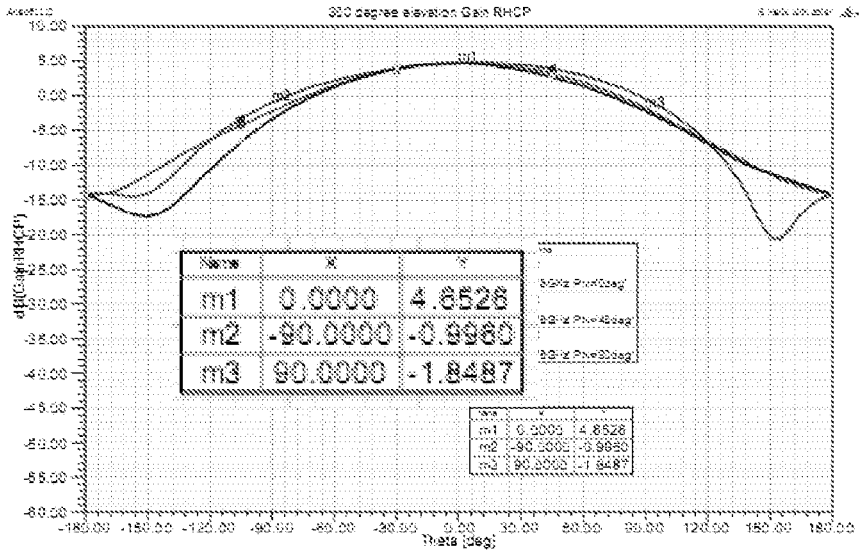

FIGS. 8*a* to 8*c* show the radiation patterns with 35 mm monopoles, a 10 mm collar and a 40 mm collar. The collar improves the low elevation angle performance, although not as smoothly as the monopoles. The variation between cuts at different azimuth angles can be traced back to degraded axial ratio and misaligned phase centers The above diagrams show that the use of monopoles in the near field loads the antenna and improves the low elevation angle performance while unexpectedly retaining good axial ratios. It would be expected that the monopoles would bias the radiation in favor of vertical polarization, thereby losing the circular polarization characteristics required for GPS and like applications. It should be noted that the mode of operation is different from the beam forming properties of parasitic monopoles in crossed dipole antenna.

The invention claimed is:

1. A quadrifilar helix antenna system with a finite electrically conductive ground plane, comprising:

a pair of bifilar helical elements on a core extending upwardly from the ground plane; and a symmetrical array of upstanding parasitic monopole elements electrically mounted on the finite electrically conductive ground plane and surrounding a lower portion of the pair of bifilar helical elements in the near field so as to load said lower portion and thereby raise the phase center of the antenna to improve the circularly polarized far-field radiation at low elevation angles.

2. A quadrifilar helix antenna system as claimed in claim 1, wherein the height and position of the parasitic monopole elements are configured such that the phase centers for different field components of the radiation are substantially lined up.

3. A quadrifilar helix antenna system as claimed in claim 1, wherein the height of the parasitic monopole elements is less than ¼ wavelength.

4. A quadrifilar helix antenna system as claimed in claim 1, wherein the parasitic monopole elements are spaced a distance between $1/6^{th}$ of a wavelength and $1/10^{th}$ of a wavelength from the core.

5. A quadrifilar helix antenna system claimed in claim 1, wherein the ground plane is less than one wavelength across.

6. A quadrifilar helix antenna system as claimed in claim 1, wherein the height and number/density of the parasitic monopole elements is selected such that it improves low elevation angle coverage without negatively affecting pattern symmetry.

7. A quadrifilar helix antenna system as claimed in claim 2, wherein the height of the parasitic monopole elements is about 0.6 the height of the antenna.

8. A quadrifilar helix antenna as claimed in claim 1, wherein the array of parasitic monopole elements comprises four upstanding monopole elements arranged at the corners of a square.

9. A quadrifilar helix antenna system as claimed in claim 1, wherein the parasitic monopole elements comprise upstanding conductive rods.

10. A quadrifilar helix antenna system as claimed in claim 1, wherein the finite ground plane forms part of a printed circuit board mounting electronic components.

11. A method of improving the performance of a quadrifilar helix antenna system with an electrically conductive finite ground plane at low elevation angles, comprising:

surrounding a lower portion of a pair of bifilar helical elements on a core forming part of the antenna system with a symmetrical array of upstanding parasitic monopole elements in the near field, said parasitic monopole elements being electrically mounted on the finite electrically conductive finite ground plane; and using the symmetrical array of upstanding parasitic monopole elements to load the lower portion and thereby raise the phase center of the antenna.

12. A method as claimed in claim 11, wherein the height and position of the parasitic monopole elements are configured such that the phase centers for different field components of the radiation are lined up.

13. A method as claimed in claim 12, wherein the height of the parasitic monopole elements is adjusted such that it improves low elevation angle coverage without negatively affecting pattern symmetry.

14. A method as claimed in claim 11, wherein the height of the parasitic monopole elements is less than ¼ wavelength.

15. A method as claimed in claim 13, wherein the height of the parasitic monopole elements is about 0.6 the height of the antenna.

16. A method as claimed in claim 11, wherein the parasitic monopole elements are spaced a distance between $1/6^{th}$ of a wavelength and $1/10^{th}$ of a wavelength from the core.

17. A method as claimed in claim 11, wherein the array of parasitic monopole elements comprises four upstanding monopole elements arranged at the corners of a square, wherein the diagonals of the square bisect the angle between adjacent termination points of the bifilar helical elements on the finite ground plane.

18. A method as claimed in claim 11, wherein the parasitic monopole elements comprise upstanding conductive rods.

19. A method as claimed in claim 11, wherein the finite ground plane forms part of a printed circuit board mounting electronic components.

20. A quadrifilar helix antenna system with a finite electrically conductive Ground plane, comprising:

a pair of bifilar helical elements on a core extending upwardly from the ground plane; and a symmetrical array of upstanding parasitic monopole elements on the finite electrically conductive ground plane having a height less than ¼ wavelength and surrounding a lower portion of the pair of bifilar helical elements in the near field so as to load said lower portion and thereby raise the phase center of the antenna to improve the circularly polarized far-field radiation at low elevation angles.

* * * * *